United States Patent [19]

Grierson et al.

[11] 3,988,118

[45] Oct. 26, 1976

[54] TUNGSTEN-NICKEL-IRON-MOLYBDENUM ALLOYS

[75] Inventors: Robert Grierson, Kokomo, Ind.; Earl I. Larsen, Sarasota, Fla.

[73] Assignee: P. R. Mallory & Co., Inc., Indianapolis, Ind.

[22] Filed: Mar. 10, 1975

[21] Appl. No.: 556,607

Related U.S. Application Data

[63] Continuation of Ser. No. 362,195, May 21, 1973, abandoned, which is a continuation of Ser. No. 125,691, March 18, 1971, abandoned.

[52] U.S. Cl. ..... 29/182; 75/176; 148/126; 164/138; 249/135

[51] Int. Cl.[2] ..... C22C 1/04; C22C 27/04; B22C 1/00; B28B 7/34

[58] Field of Search ..... 29/182; 75/176; 148/126; 249/135; 164/138

[56] References Cited

UNITED STATES PATENTS

| | | | |
|---|---|---|---|
| 2,793,951 | 5/1957 | Green et al. | 75/214 |
| 3,145,100 | 8/1964 | Tarkan et al. | 75/20 |
| 3,150,971 | 9/1964 | Weisert et al. | 75/176 |
| 3,177,076 | 4/1965 | Timmons et al. | 75/176 |
| 3,184,304 | 5/1965 | Andes | 75/134 |
| 3,378,671 | 4/1968 | Harrison et al. | 75/176 |
| 3,638,293 | 2/1972 | Peterson | 29/182 |
| 3,656,731 | 4/1972 | Larsen | 249/135 |

FOREIGN PATENTS OR APPLICATIONS

| | | | |
|---|---|---|---|
| 1,012,078 | 7/1957 | Germany | 75/176 |
| 901,823 | 7/1962 | United Kingdom | 75/176 |

OTHER PUBLICATIONS

Holtz et al. "Development and Evaluation of High Temperature Tungsten Alloys," Armor Research Foundation of I.I.T. WABC Tech. Report 59–19.

*Primary Examiner*—Richard E. Schafer
*Attorney, Agent, or Firm*—Hoffmann, Meyer & Hanson

[57] ABSTRACT

This invention is directed to the use of tungsten base alloys containing about 1 to 12 weight percent nickel, about 0.5 to 8 weight percent iron and about 0.5 to about 25 percent molybdenum and at least one additional additive selected from cobalt, chromium, manganese, vanadium, tantalum, zirconium, titanium, yttrium, rhenium, boron, and silicon. Chromium may substitute for molybdenum up to 15%. In addition to being useful for high density applications, structural applications, and high temperature applications, the alloys may be used for die casting dies, molds, cores and other metal shaping members.

10 Claims, 6 Drawing Figures

INVENTORS
EARL I. LARSEN
ROBERT GRIERSON
BY Henry W. Cummings
ATTORNEY

TUNGSTEN-NICKEL-IRON-MOLYBDENUM ALLOYS

This is a continuation of application Ser. No. 362,195, filed May 21, 1973, now abandoned, which was in turn a continuation of Ser. No. 125,691, filed Mar. 18, 1971, now abandoned.

In a previous patent application Serial No. 855,701, filed Dec. 5, 1969, now U.S. Pat. No. 3,656,731, tungsten base alloys were described containing specified amounts of nickel, iron and molybdenum for high temperature shaping members and tooling components.

Tooling components formed from these compositions operate very satisfactorily in producing both ferrous and non-ferrous castings resulting in much greater shaping member and die component life.

However, in connection with further investigations in this area, it has been found that certain additional elements when used in conjunction with the foregoing elements result in increased benefits and improved properties over those obtained with the above identified tungsten-nickel-iron molybdenum shaping members.

An additional object of the investigations has been to develop alloys for general use and application. In this connection certain compositions have been developed which appear to be useful not only in the shaping member area but in a wide variety of articles and structural components.

It is an object of the present invention to provide alloy compositions having increased mechanical properties at room temperature.

It is another object of the present invention to provide compositions which have improved mechanical properties.

It is another object of the present invention to provide alloys which have increased resistance to thermal fatigue.

It is another object of the present invention to provide alloys which have increased resistance to corrosion.

It is another object of the present invention to provide alloys which have increased resistance to oxidation.

It is another object of the present invention to provide shaping members which operate for extended periods of time without replacement.

It is another object of the present invention to provide shaping members which will operate at higher temperatures.

It is another object of the present invention to provide shaping members which are resistant to corrosion during operation.

It is another object of the present invention to provide shaping members which are more resistant to oxidation during operation.

It is, therefore, an object of the invention to provide a die casting dies or molds, cores and other metal shaping members which have a long life.

It is another object of the invention to provide a die casting dies, molds, cores, core pins and other metal shaping members which will be resistant to erosion when subjected to the washing action of molten metals and alloys, including ferrous and non-ferrous metals and alloys such as copper, brass or bronze, aluminum and aluminum alloys, zinc and zinc alloys, magnesium and magnesium alloys.

Another object of the invention is to provide die casting dies, and other shaping members which will resist cracking or spalling when subjected to the thermal stresses created by molten metals and alloys being forced into dies and molds under pressure.

Another object of the present invention is to provide shaping members which have resistance to thermal shock.

Still another object of the invention is to provide shaping members which have resistance to erosion.

Still another object of the invention is to provide shaping members which are resistant to spalling.

Still another object of the invention is to provide shaping members which are resistant to cracking.

Still another object of the invention is to provide shaping members which have low surface roughness after continued operation.

It is another object of the present invention to provide shaping members which require cleaning less frequently.

It is another object of the invention to provide shaping members having good mechanical properties both at room temperature and at elevated temperatures encountered in die casting operations.

Another object of the present invention is to provide shaping members which rapidly remove heat from the metals and alloys being cast.

Another object of the present invention is to provide a method of casting resulting in increased life of casting components including dies, molds, cores, core pins and other shaping members.

Another object of the present invention is to provide a method of increasing the life of casting components including dies, molds, cores, core pins and other shaping members.

Other objects will be apparent from the following description and drawings.

Figure 1:
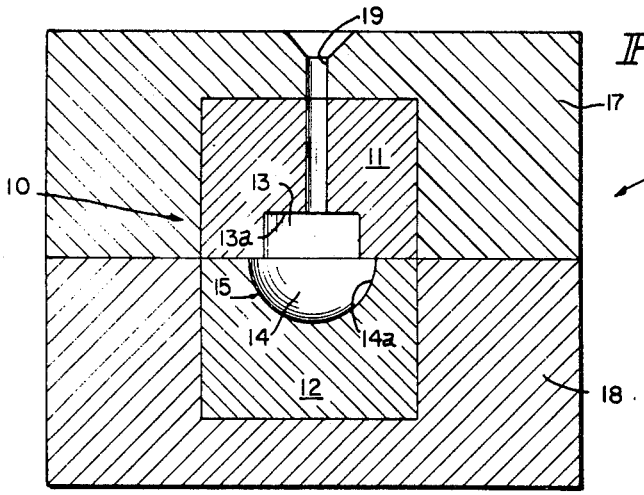
FIG. 1 is a cross section of an exemplary die casting die or mold.

As disclosed in U.S. Pat. No. 3,656,731, referred to above, tungsten based alloys containing iron and nickel additives can be formed by powder metallurgy and liquid phase sintered at reasonable temperatures to make articles having densities very near theoretical with high yield and tensile strengths, good ductility, good impact strength, and high resistance to thermal shock. Such alloys are readily machined utilizing ordinary machine shop tools and practices so that intricate cavity shapes can be readily formed. And tungsten-iron-nickel alloys are susceptible to heat treatment which increases not only their tensile properties, but more important for casting applications, their ductility.

It has been found that when molybdenum is added to the tungsten-iron-nickel material, improvement of some of the mechanical properties including strength of the shaping members, both at room temperature and more importantly at elevated temperatures is observed as well as is an increased resistance to thermal shock. It is this effect at least in part that results from the strengthening of the iron-nickel matrix by the solution of molybdenum in the matrix during liquid phase sintering. The amount of molybdenum added is a balance between the amount needed to be effective in increasing the mechanical properties and the amount which adversely effects the shrinkage characteristics of the material. Thus the amount of molybdenum added must be controlled such that thermal cracking due to the expansion of the components of the material is avoided when the working surfaces of the die are exposed to the elevated temperature of the molten metal being cast. Yet sufficient molybdenum must be added to take advantage of the improved mechanical properties of the molybdenum containing material. Amounts of up to about 25 percent by weight have been found to improve the strength and hardness. Amounts less than about 0.5% by weight have little or no significant effect on the shaping member properties. The preferred molybdenum content is from about 2 to about 8 weight percent to effect a suitable balance. Amounts of up to about 6% are particularly preferred.

Thus, in accordance with the present invention, it has been found that tungsten base alloys containing from 0.5 to about 12% nickel, from 0.5 to about 8% iron, and from 0.5 to about 25% molybdenum may be satisfactorily used together with at least one additional element which either increases the mechanical properties at room temperature including strength, ductility and/or increases the corrosion resistance and resistance to oxidation at elevated temperatures and/or increases the resistance to thermal fatique. These additives include cobalt, chromium, manganese, vanadium, tantalum, zirconium, titanium, yttrium, rhenium, boron and silicon. These elements may be used singly or in combination with an amount of at least 0.01% each up to an amount of 15% total.

Certain of these elements provide resistance to corrosion and particularly resistance to oxidation at elevated temperature. These elements include chromium, rhenium, yttrium, and/or silicon. These elements may be added in an amount of from 0.1 each to 15% total preferably in an amount from 0.2 each up to 5% total. In regard to these elements it should be pointed out first that chromium, in addition to increasing the oxidation resistance at elevated temperatures, chromium, together with rhenium increase the elevated temperature strength and hardness at temperatures up to 1800° F and higher.

Another element which increases the elevated temperature tensile strength and hardness is boron in an amount from 0.05 to 0.5%. It is believed that this effect results from combinations of boron with molybdenum and/or tungsten.

Another useful element is cobalt. Cobalt inhibits the formation of undesirable intermetallic compounds, including for example, compounds of tungsten and nickel, and compounds of molybdenum and iron. Cobalt should be used in the range of about 0.5 to 5%.

It has further been found that manganese improves the ductility of tungsten-nickel-iron-molybdenum alloys. Manganese improves the torsional ductility and specimens containing the above elements with manganese have been subjected to torsional twists up to 630° and higher successfully. Another advantage of manganese is that it makes the material less notch sensitive up to about 10 foot pounds and higher.

Still another element which may be utilized in accordance with the present invention is vanadium in an amount of 0.5 to 5% by weight. Vanadium improves the room temperature and elevated temperature tensile strength, hardness and ductility, and vanadium produces grain refinement of the matrix of the liquid phase sintered component. This grain refinement is believed also the reason why improved ductility is observed and at the same time improved strength and hardness.

It was indicated above that chromium is an element which may be added for improved elevated temperature strength and corrosion resistance. Furthermore, it has been found that chromium in an amount up to 15% may substitute for some or all of the molybdenum in accordance with the present invention. In other words, the present invention encompasses alloys containing 0.5 to 12% nickel, 0.15 to 8% iron, and 0.5 to 15% chromium. However, chromium additions are particularly effective in combination with molybdenum as can be seen from the data hereinafter presented.

The tungsten alloys of the present invention should contain from about 55 to about 98 weight percent tungsten, form about 1 to about 12 percent nickel and from about 0.5 to about 7.5 percent iron. The ratio of nickel to iron in the shaping members of the present invention should be from about 1 to 1 to about 4 to 1.

The preferred range for the alloys of the present invention is from about 75 to about 95 weight percent tungsten, from about 1.5 to about 8 percent nickel, from about 0.5 to about 5 percent iron, and from about 2 to about 8 weight percent molybdenum and 2 to 8% chromium with one or more of the abovementioned additives. Preferable, the ratio of nickel to iron is from about 1.5 to 1 to about 3 to 1.

In a further embodiment of the present invention, it has been found that interstitial elements including oxygen, carbon, nitrogen and hydrogen tend to embrittle tungsten-nickel-iron-molybdenum alloys, and preferably there should not be more than about 100 parts per million of each of these elements, most preferably interstitial elements should be below 10 parts per million, and below 100 parts per million total.

The shaping members of the present invention generally have a tensile strength of at least 130,000 psi at room temperature and a yield strength of at least 85,000 psi at room temperature. Values of 140,000 psi and higher tensile and 125,000 psi and higher yield can be obtained with tungsten contents of about 90%. Elongation is important because the shaping members must withstand thermal shock. The elongation is usually at least two percent for this reason and is often at least three percent.

Through heat treating, elongations of from 5 to 25 percent can be achieved and elongations in this range are the most preferred for applications requiring particularly high resistance to thermal shock.

The preferred method of heat treatment comprises heating the sintered compact to a temperature of 500°–1200° C in a neutral or slightly reducing atmosphere for about one-half to twelve hours and then quenching rapidly.

Some exemplary compositions and properties are given in Table I.

TABLE I

COMPOSITIONS OF SELECTED TUNGSTEN BASE EXPERIMENTAL ALLOYS

Sample

TABLE I-continued

COMPOSITIONS OF SELECTED TUNGSTEN BASE EXPERIMENTAL ALLOYS

| No. | W | Ni | Fe | Mo | Co | Cr | Mn | V | Ta | Zr | Ti |
|---|---|---|---|---|---|---|---|---|---|---|---|
| 1 | 80 | 10 | | | | 10 | | | | | |
| 2 | 80 | 8 | 2 | 4 | | 6 | | | | | |
| 3 | 72 | 8 | 2 | 4 | | 14 | | | | | |
| 4 | 60 | 18 | 2 | 4 | 4 | 10 | | 2 | | | |
| 5 | | | | | | | | | | | |
| 6 | 90 | 4.5 | 1 | 0.50 | | 4 | | | | | |
| 7 | 80 | 7 | 3 | 10 | | | | | | | |
| 8 | 75 | 6.5 | 2 | 10 | | 6.5 | | | | | |
| 9 | 90 | 7 | 3 | | | | | | | | |
| 10 | 90 | 7 | 3 | | | | | | | | |
| 11 | 90 | 7 | 3 | 0.45 | | | | | | | |
| 12 | 65 | 8 | 2 | 4 | 12.38 | 7.5 | 1 | | | | |
| 13 | 85.5 | | | | | 13 | | | 1.5 | | |
| 14 | 86 | | 0.50 | | | 13 | | | 0.5 | | |
| 15 | 85 | 4.55 | | 1.5 | | 7.95 | 1 | | | | |
| 16 | 75 | | | 25 | | | | | | 0.1 | |
| 17 | 56.6 | | | | | | | 15.6 | 27.8 | | |
| 18 | 80 | 4 | 2 | 7.2 | 4 | 2.8 | | | | | |
| 19 | 70 | 21 | 9 | | | | | | | | |
| 20 | 70 | 21 | 9 | | | | | | | | 0.5 |
| 21 | 70 | 21 | 9 | | | | | | | | 1 |
| 22 | 70 | 21 | 9 | 0.45 | | | | | | | |
| 23 | 60 | 24.4 | 6.4 | | | 6 | 3.2 | | | | |
| 24 | 80 | 12.2 | 3.2 | | | 3 | 1.6 | | | | |
| 25 | 70 | 21 | 9 | 2 | | | | | | | 0.8 |
| 26 | 88.13 | 3.8 | 1.41 | | | 3.8 | | | | | |
| 27 | 91.6 | 3.96 | 1.46 | | | | | | | | |
| 28 | 80 | | | | | | | | | | |
| 29 | 80 | 6.8 | | | | 6.8 | | | | | |
| 30 | 80 | 10 | | | | | | | | | |
| 31 | 78.14 | 6.557 | 2.185 | | | | | | | | |
| 32 | 80 | 8 | 4 | 8 | | | | | | | |
| 33 | 70 | 12 | 6 | 12 | | | | | | | |
| 34 | 60 | 16 | 8 | 16 | | | | | | | |
| 35 | 70 | 5.3 | 2.6 | 22 | | | | | | | |
| 36 | 78 | 4.8 | 2.4 | 14.75 | | | | | | | 0.15 |
| 37 | 78 | 4.8 | 2.4 | 14.75 | | | | | | | 0.25 |
| 38 | 98 | 1.33 | 0.66 | | | | | | | | |

| Sample No. | Y | Re | B | Si | Density | Hardness | 0.2 % Y.S. psi | Ult. psi | % Elongation |
|---|---|---|---|---|---|---|---|---|---|
| 1 | | | | | 14.64 | 46 Rc | — | 172,951 | 1 |
| 2 | | | | | 15.26 | 45 " | — | 163,000 | 2 |
| 3 | | | | | 13.64 | 55 " | — | 87,700 | None |
| 4 | | | | | 12.16 | 36 " | — | 126,100 | 2 |
| 5 | | | | | | | | | |
| 6 | | | | | 16.68 | 38 " | — | 137,880 | 2 |
| 7 | | | | | 15.84 | 36 " | — | 157,600 | 6 |
| 8 | | | | | 14.54 | 46 " | — | 160,000 | 0.5 |
| 9 | 0.75 | | | | — | — | — | — | — |
| 10 | 1.00 | | | | — | — | — | — | — |
| 11 | | | 0.05 | | 16.16 | 30 " | — | 111,900 | 1.0 |
| 12 | | | | 0.12 | — | 33 " | — | — | — |
| 13 | | | | | — | — | — | — | — |
| 14 | | | | | — | — | — | — | — |
| 15 | | | | | — | 44 " | — | — | — |
| 16 | | | | | — | 19 – | — | — | — |
| 17 | | | | | — | — | — | — | — |
| 18 | | | | | 15.28 | 54 " | — | 21,600 | Brittle |
| 19 | | | | | 13.99 | 23 " | — | 119,090 | 17.0 |
| 20 | | | | | 13.07 | 28 " | — | 106,500 | 7 |
| 21 | | | | | 13.33 | 25 " | — | 94,050 | 4.5 |
| 22 | | | 0.05 | | — | — | — | — | — |
| 23 | | | | | — | — | — | — | — |
| 24 | | | | | 14.9 | 27 " | — | 111,800 | 3 |
| 25 | | | | | 13.35 | 21 " | — | 100,900 | 9.5 |
| 26 | | 2.86 | | | 16.71 | 40 " | — | 134,000 | None |
| 27 | | 2.98 | | | 18.04 | 41 " | — | 150,000 | None |
| 28 | | | | | — | — | — | — | — |
| 29 | | | | | — | — | — | — | — |
| 30 | | | | | — | — | — | — | — |
| 31 | | | | | — | — | — | — | — |
| 32 | | | | | 15.77 | 38 " | — | 164,200 | 6.2 |
| 33 | | | | | 14.82 | 38.5 Rc | — | 168,000 | 5.8 |
| 34 | | | | | 13.82 | 36.5 " | — | 150,800 | 6.6 |
| 35 | | | | | — | 43 Rc | 107,000 | 122,000 | 1.2 |
| 36 | | | | | — | 38 " | 138,000 | 153,000 | 2.8 |
| 37 | | | | | — | 39 " | 118,000 | 143,000 | 3 |
| 38 | | | | | — | — | 85,000 | 113,000 | 5 |

The high termal conductivity of the alloys of the present invention when used as shaping members tends to result in solid, sound castings; and the rapid rate of heat removal tends to reduce welding and erosion and thermal stresses.

The shaping members of the present invention can withstand many more cycles of operation than steel shaping members before such polishing and/or machining is necessary. The shaping surface of the shaping members of the present invention almost always has a surface roughness below about $300 \times 10^{-6}$ inches after 50,000 cycles. It is usually below $300 \times 10^{-6}$ inches after 125,000 cycles. In fact, in many instances the surface roughness is below $200 \times 10^{-6}$ inches after 100,000 or 120,000 cycles.

Tests have been conducted on various tooling components such as die casting dies, core pins, plungers, sprue pins, etc. In a typical die casting die wherein brass castings were formed, 52,000 castings were made. The brass was injected into the die at a pressure of about 18,000 psi. The temperature of the brass was about 1750° F. Under these conditions, typical tool steel dies had an average life of 5,000 castings.

Tensile strength at elevated temperature is generally good for the alloys of the present invention. It has been found that in short time tensile tests the following tensile strengths can usually be obtained with the alloys of the present invention:

| | SHORT TIME TENSILE STRENGTHS | | |
|---|---|---|---|
| Temp (° F) | Tensile Strengths (psi) | Preferred | Typical |
| 1200° F | 75,000 psi | 100,000 psi | 125,000 psi |
| 1500° F | 52,000 psi | 90,000 psi | 95,000 psi |
| 1800° F | 35,000 psi | 50,000 psi | 54,000 psi |
| 2000° F | 20,000 psi | 30,500 psi | 34,000 psi |

Still another important property of the alloys of the present invention is the thermal conductivity or the rate at which heat is transferred through the alloys of the present invention. The thermal conductivity at room temperature is usually about 0.20 cgs units and preferably it is about 0.30 cgs units.

In accordance with another embodiment of the present invention a shaping member such as a die, mold, core or other metal shaping member is utilized having a molding surface comprising a tungsten-iron-nickel alloy previously described. For example, the shaping members may comprise one or more die blocks defining a portion of a die cavity, as well as cores, core pins and other metal shaping members commonly associated with ferrous and non-ferrous casting, particularly die casting. The conduit or conduits, or other means to conduct molten metal to the casting cavity may also utilize surfaces made of the previously described alloys, if desired.

Referring now to FIG. 1, an exemplary die casting die or mold 10 in the main comprises at least two blocks 11 and 12 each having a cavity 13 and 14 the blocks being positioned adjacent each other to form a continuous die cavity 15 for forming a metal part. As shown, the casting die is held within a block housing 16 composed of two sections 17 and 18. Molten metal, from which the part is to be formed, is fed to the cavity 15, under pressure, by way of conduit 19. The shape of cavity 15 is determined by molding surfaces 13*a* and 14*a*. The shape of the cavity as shown in FIG. 1 is by way of illustration only, the particular shape being cast being dependent upon the shape of the part desired.

An important feature of the present invention lies in the material used to fabricate the shaping members such as blocks 11 and 12 which define the surfaces 13*a* and 14*a*. A tungsten base alloy containing iron, nickel and molybdenum or chromium is used to give dies and other shaping members longer life even though high melting point metals and alloys such as case iron, steel, copper, bronzes and brasses or other non-ferrous metals such as aluminum, aluminum alloys, zinc, zinc alloys, magnesium and magnesium alloys are being molded. It is within the scope of the invention to form such surfaces from a tungsten-nickel-iron-molybdenum-chromium alloy coating upon the die blocks, cores, core pins, or other shaping members.

Figure 2:
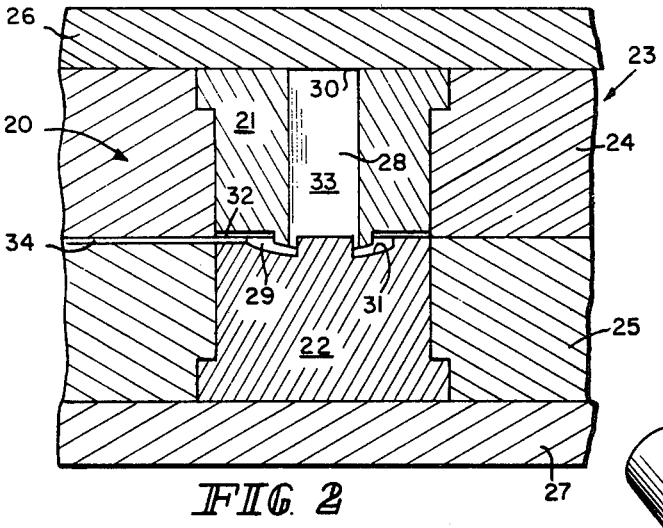
FIG. 2 is a cross section of another exemplary die or mold.

With particular reference to FIG. 2, another embodiment of the present invention is described. In FIG. 2, a die casting die or mold 20 is formed from two split sections or blocks 21 and 22, the blocks being fabricated from the tungsten base alloy of the present invention by liquid phase sintering. The die is held within a block housing 23 that is principally made up of two sections 24 and 25 and backing plates 26 and 27.

Each section of the die contains a cavity 28 and 29 each having a mold surface 30 and 31, the cavities being machined into the blocks. Cavities 28 and 29 together with the space 32 formed by the space relationship of the blocks 21 and 22 form the continuous die cavity 33. The particular part being formed by the casting die in this instance comprises a faucet nut having approximately ⅝ inch I.D., a 1 inch O.D. and a length of ¾ inch. The molten metal used to form the article is fed to the cavity through conduit 34.

After forming blocks 21 and 22 with their cavities, the blocks were heat treated to increase their ductility such that an elongation of about 15% was achieved.

FIGS. 3 through 6 depict various other high temperature tooling components used in the die casting and plastic injection molding industries wherein the tungsten-iron-nickel-molybdenum alloy of the present invention has been found to be remarkably superior to prior art materials used in fabricating the components. It should be understood, however, that the components shown are merely illustrative and not exhaustive in scope.

Figure 3:
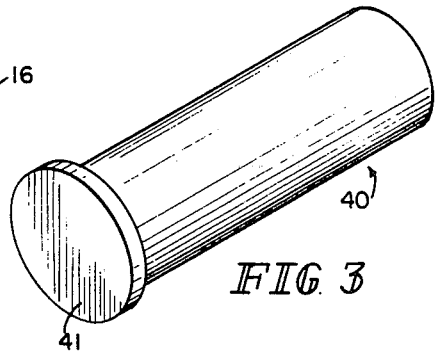
FIGS. 3 through 6 are perspective views of exemplary shaping members which may be utilized in accordance with the present invention.
Figure 4:
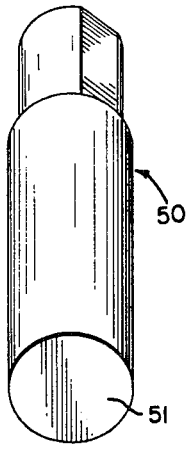
Figure 5:
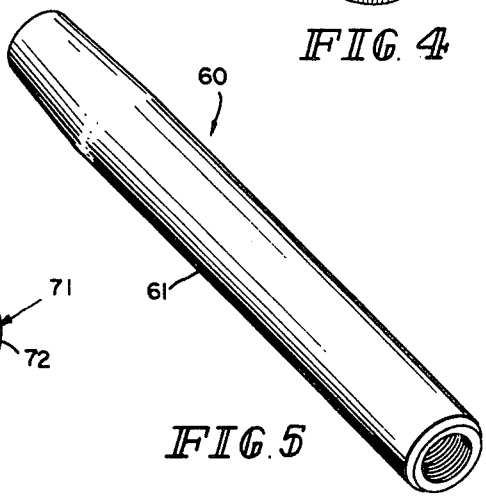
Figure 6:
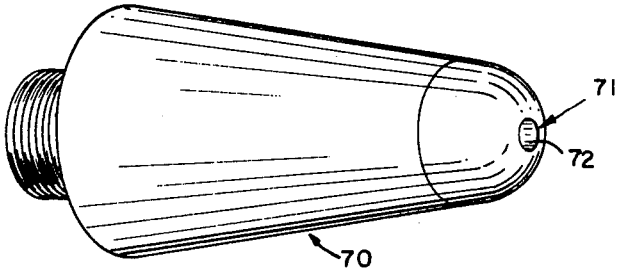

In FIG. 3 there is shown a sprue pin 40 whose working surface 41 normally forms a part of the die cavity and which is used to knock out the formed part from the die cavity. In FIG. 4 there is shown a plunger tip 50 having a working face 51. The tip is used to force molten metal into the die cavity, the molten metal being forced through by the working face 51. FIG. 5 shows a core pin 60 having an outer diameter forming a working face 61 which forms the inside diameter of a casting. FIG. 6 illustrates a nozzle 70 having a bore 71 through which the molten material for metal or plastic injection molding is fed under pressure. As such, the surface 72 forming the bore 71 is subjected to the thermal stresses imposed by the washing action of the hot material being fed through the nozzle 70.

We claim:

1. A sintered W based alloy consisting essentially of about 55 to about 98 wt.% W, about 0.5 to about 12 wt.% Ni, about 0.5 to about 8 wt.% Fe, the ratio of Ni to Fe is from about 1:1 to about 4:1, about 0.5 to about 25 wt.% Mo, and about 0.01 each to about 15 wt.% total of a property improving element selected from the group of V, Ta, Zr, Mn, Ti, Y, Re, B, Si and mixtures thereof.

2. The sintered W based alloy of claim 1 for use as a shaping surface of a shaping member for high temperature forming of metals.

3. The sintered W based alloy of claim 1, wherein the property improving element is selected from the group of about 0.2 wt.% each to about 5 wt.% total of an element selected from the group of Y, Re, Si, about 0.5 wt.% to about 5 wt.% V, about 0.05 wt.% to about 0.5 wt.% B, and mixtures thereof.

4. A sintered W based alloy heat treated by heating to a temperature of about 500° C to about 1200° C in a neutral or reducing atmosphere for at least one half hour and quenching consisting essentially of about 75 to about 95 wt.% W, about 1.5 to about 8 wt.% Ni, about 0.5 to about 5 wt.% Fe, the ratio of Ni to Fe is from about 1.5:1 to about 3:1, about 2 to about 8 wt.% Mo, about 2 to about 8 wt.% Cr, and a property improving element selected from the group of about 0.5 to about 5 wt.% Re, Y, Si and V, about 0.05 to about 0.5 wt.% B, about 0.01 to about 1.0 wt.% Mn, about 0.01 to about 0.8 wt.% Ti and mixtures thereof.

5. The sintered W based alloy of claim 4, for use as a shaping surface of a shaping member for high temperature forming of metals.

6. The sintered W based alloy of claim 4, wherein the Mo is from about 2 to about 6 wt.%.

7. The sintered W based alloy of claim 4, for use as a shaping surface of a shaping member for high temperature forming of metals having a tensile strength of at least about 130,000 psi at room temperature, a yield strength of at least 85,000 psi at room temperature, and a thermal conductivity of at least about 0.20 cgs units at room temperature.

8. A sintered W base alloy consisting essentially of about 75 to about 95 wt.% W, about 1.5 to about 8 wt.% Ni, about 0.5 to about 5 wt.% Fe, the ratio of Ni to Fe is from about 1.5:1 to about 3:1, about 2 to about 8 wt.% Mo, about 2 to about 8 wt.% Cr, and a property improving element selected from the group of about 0.5 to about 5 wt.% Y, Si and V, about 0.05 to about 0.5 wt.% B, about 0.01 to about 1.0 wt.% Mn, about 0.01 to about 0.8 wt.% Ti and mixtures thereof.

9. The sintered W based alloy of claim 8, wherein the property improving element is about 0.2 each up to a mixture total of about 5 wt.% of the total wt. of the alloy, and the Mo is about 2 to about 6 wt.%, the property improving element selected from the group consisting of Y, V, Si and mixtures thereof.

10. The sintered W base alloy of claim 8 wherein the property improving element is Mn.

* * * * *